US005913333A

United States Patent [19]

Biener et al.

[11] Patent Number: 5,913,333

[45] Date of Patent: Jun. 22, 1999

[54] HYDRAULICALLY ACTUATABLE DIRECTIONAL CONTROL VALVE

[75] Inventors: Rainer Biener, Steinfeld-Hausen; Richard Rauscher, Gemünden/Main; Winfried Rüb, Neustadt/Main, all of Germany

[73] Assignee: Mannesmann Rexroth AG, Lohr/Main, Germany

[21] Appl. No.: 08/930,715

[22] PCT Filed: Mar. 2, 1996

[86] PCT No.: PCT/EP96/00886

§ 371 Date: Sep. 18, 1997

§ 102(e) Date: Sep. 18, 1997

[87] PCT Pub. No.: WO96/30653

PCT Pub. Date: Oct. 3, 1996

[30] Foreign Application Priority Data

Mar. 31, 1995 [DE] Germany ..... 195 12 007

[51] Int. Cl.[6] ..... F15B 13/043

[52] U.S. Cl. ..... 137/625.64; 29/890.127; 137/596.2

[58] Field of Search ..... 137/596.2, 625.64; 29/890.127

[56] References Cited

U.S. PATENT DOCUMENTS

| | | | |
|---|---|---|---|
| 4,046,165 | 9/1977 | Rose, Sr. et al. . | |
| 4,126,293 | 11/1978 | Zeuner et al. . | |
| 4,290,447 | 9/1981 | Knutson | 137/596.2 |
| 4,357,955 | 11/1982 | Sauer | 137/625.64 X |
| 4,569,273 | 2/1986 | Anderson et al. | 137/625.64 X |
| 5,372,060 | 12/1994 | Maruyama et al. . | |
| 5,394,903 | 3/1995 | Tominaga . | |

FOREIGN PATENT DOCUMENTS

| | | |
|---|---|---|
| 2850272 | 6/1980 | Germany . |
| 3214845 | 11/1983 | Germany . |

*Primary Examiner*—Gerald A. Michalsky
*Attorney, Agent, or Firm*—Martin A. Farber

[57] ABSTRACT

In a hydraulically actuatable directional control valve the servo-piston of which is to be controlled by electromagnetically actuatable pilot valves of small nominal size developed as insertion cartridges integrated in the directional control valve housing, the hydraulic connection between the pilot valves and the directional control valve are effected via channels extending in the directional control valve housing, the channels in the directional control valve housing are produced as cast channels, in particular for mass production, and the connections of the pilot valves are adapted to the size and arrangement of these channels.

1 Claim, 1 Drawing Sheet

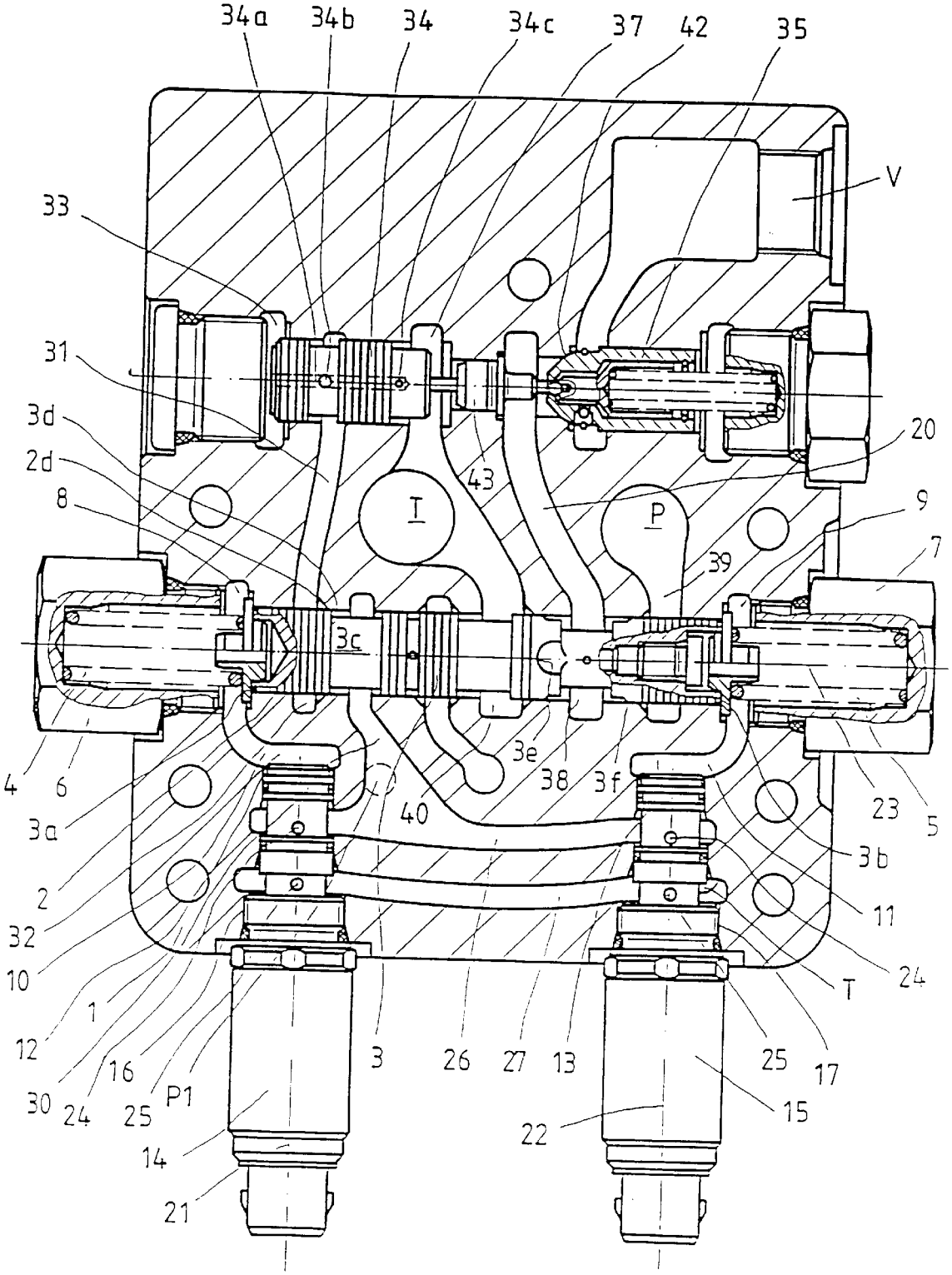
34a
34b
34
34c
37
42
35
V
33
31
3d
2d
8
20
43
T
P
9
7
39
3c
4
6
3a
2
32
10
1
12
30
24
16
25
P1
14
21
3
26
27
13
22
25
17
15
T
24
11
3b
23
5
3e
38
3f
40

HYDRAULICALLY ACTUATABLE DIRECTIONAL CONTROL VALVE

FIELD AND BACKGROUND OF THE INVENTION

The present invention relates to a hydraulically actuatable directional control valve, particularly a directional proportional control valve, which is to be controlled by electromagnetically actuated pilot valves of small nominal sizes.

In connection with these valves, it is known to fasten the pilot valves of small nominal size having a housing of their own to the lateral end surfaces of the housing of the directional control valve and to establish the hydraulic connection and of these pilot valves with the tank and pressure connection with the directional control valve via bored channels in the housing of the directional control valve. Since the connection pattern of the known pilot valves of small nominal size has results in connecting channels of small diameter at a slight distance from each other, the introduction of these connecting channels in the form of bore holes requires a considerable manufacturing expense. Instead of pilot valves which are fastened to the side of the housing of the directional control valve, it is also known to develop the pilot valves as insertion cartridges and screw them into the housing of the directional control valve parallel to the actuation axis of the servo-piston of the directional control valve and to connect the pilot valves hydraulically to the directional control valve by separate bore holes in the housing of the directional control valve. Such a development and arrangement of the pilot valves in the housing of the directional control valve requires expensive production of the connecting bore holes, particularly as they must close in pressure-tight fashion, without leakage towards the outside.

SUMMARY OF THE INVENTION

The object of the present invention is therefore to create a development and arrangement of the pilot valves on the directional control valve which assures an inexpensive manufacture of the directional control valve with pilot valves, particularly in the case of mass production.

According to the invention, due to the fact that the hydraulic connecting of the pilot valves developed as insertion cartridges to the directional control valve is effected via channels cast in the housing of the directional control valve and the connections of the insertion cartridges of each pilot valve are adapted to the geometry of the cast channels, inexpensive mass production of these valves can, in particular, be obtained in a simple manner.

BRIEF DESCRIPTION OF THE DRAWINGS

With the above and other objects and advantages in view, the present invention will become more clearly understood in connection with a detailed description of the sole FIGURE showing in cross-section an embodiment of a hydraulically actuatable directional control valve in accordance with the invention.

DETAILED DESCRIPTION OF THE PREFERRED EMBODIMENTS

In the sole FIGURE of the drawing, 1 is the cast-iron housing of the directional control valve which contains a servo-piston 3 in a passage bore hole 2. The servo-piston is fixed at its end sides 3*a*, 3*b* by springs 4, 5 in the initial position shown. The ends of the springs facing away from the servo-piston rest against hollow closure screws 6, 7. The ends of the servo-piston define control spaces 8, 9 which can be acted on by control liquid and are connected via channels 10, 11 to the corresponding outlet spaces 12, 13 of the electromagnetically actuatable pilot valves 14, 15 which are developed as insertion cartridges. The pilot valves are developed as pressure control valves and screwed into corresponding recesses 16, 17 in the cast-iron housing 1.

The control pressure acting in the control spaces 8, 9 displaces the servo-piston 3 against the force of the corresponding springs 4, 5, the consumer connecting channel 20 being connected either to the pump connection P or to the tank connection T, depending on the direction of displacement of the servo-piston. The actuation axes 21, 22 of the pilot valves extend parallel to each other and perpendicular to the actuation axis 23 of the servo-piston 3. As a result, there is a particularly simple channel path for the feeding and discharge of the control liquid to and from the pilot valves.

The connection bore holes 24 which are connected to the source of control pressure agent P1 and the connecting holes 25 of the pilot valves which are connected to the tank connection T match the channels 26, 27 cast in the cast-iron housing which extend parallel to each other, the channel 26 being in communication with the source of control pressure agent P1 and the channel 27 with the tank T. The channel 26 which is connected to the source of control pressure agent P1 is connected via a transversely extending channel-shaped recess 30 with the passage bore 2 for the servo-piston 3. The servo-piston 3 narrows down in the manner of a neck at the entrance place 3*c* and is therefore of smaller diameter at this place. In this way there is obtained a control edge 3*d* which cooperates with a corresponding control edge 2*d* of the passage bore. The control edge 2*d* results from a widening of the passage bore to a control space 32 which communicates via a connecting channel 31 with the control space 33 of an actuating control piston 34 for a holding piston 35 developed as non-return valve for the consumer (not shown). The actuating control piston has a blind hole 34*a* with two radially extending bore holes 34*b*, 34*c*, in which connection control liquid can be fed from the connecting channel 31 via the bore hole 34*b* to the control space 33 of the actuating control piston when the control edge 3*d* of the servo-piston 3 is open and control liquid is to be displaced, via the bore hole 34*c* of small diameter acting as choke for the setting back of the actuating control piston, from the control space 33 to the space 37 which is connected with the tank connection T.

The servo-piston 3 has control edges 3*e*, 3*f* formed by grooves milled in the servo-piston, which control edges, depending on the direction of displacement of the servo-piston, produce the connection of the control space 38 which is connected via the holding piston 35 to the consumer, to the control space 39 which is connected to the source of working pressure agent P, or with the control space 40 which is connected to the tank. Upon actuation of, in each case, an actuation magnet of the corresponding pilot valve, a control pressure corresponding to the electric current fed is set on the pilot valve 14, 15 which pressure is present in the corresponding control space 8, 9 of the servo-piston 3 and pushes the latter against the force of the corresponding opposite spring 4, 5 until the spring force, which increases hereby, corresponds to the control pressure set. Upon actuation of the actuation magnet of the pilot valve 14, the control space 8 of the servo-piston 3 is acted on with the control pressure set on the pilot valve, and the servo-piston is displaced against the force of the opposite spring 5 by an amount corresponding to the value of the control pressure and thus via the control edges 3*f* of the servo-piston 3 which lie in open position, the control space 38 which is connected to the consumer is connected with the control space 39 connected with the source of working pressure agent so that working pressure agent acts, via the connecting channel 20, on the holding piston 35 which is lifted off from its housing seat 42 by the incoming working agent and from there further, via the consumer connection V, on the consumer (not shown), for instance a lift mechanism. Upon actuation of the actuating magnet of the pilot valve 15, the control pressure in the control space 9 which pressure is set on the pilot valve 15 acts on the servo-piston 3 and displaces it against the force of the opposite spring 4, in which connection the servo-piston 3, via its opened control edges 3*e*, forms a connection between the control space 38, which is connected via the holding piston 35 to the consumer and the control space 40 which is connected to the tank. At the same time, the surrounding control edge 3*d* of the servo-piston 3 opens the connection of the source of control pressure agent P1 with the control chamber 33 of the actuating control piston 34 so that the latter, via an intermediate member 43, lifts the holding piston off from its housing seat 42, whereby a connection is formed via the control edge 3*e* between the consumer (not shown) and the tank.

By the cast channels for the hydraulic connection of the pilot valves to the source of control pressure agent and to the tank as well as to the control spaces of the servo-piston, there results, also for additional apparatus such as the actuatable holding valve, for the consumer a further simplification of the path of the channel in the cast-iron housing of the directional control valve.

We claim:

1. A method for manufacturing a hydraulically actuatable directional control valve, wherein the valve comprises a valve housing, two pilot valves and a control piston controllable by the two pilot valves, the two pilot valves being of small nominal size, being designed as insert cartridges, and being inserted into installation bores of the valve housing; wherein the method comprises steps of constructing a first hydraulic channel and a second hydraulic channel located in said housing, and connecting each of said first and said second hydraulic channels with each of said pilot valves;

spacing the two pilot valves apart from each other in a direction of an actuation axis of the control piston;

arranging actuating axes of the two pilot valves to extend perpendicularly to an actuating axis of the control piston and parallel to the actuating axis of the other of the two pilot valves;

providing each of the pilot valves with a control pressure medium connection, a tank connection, and a third connection for connecting with a control chamber of the control piston;

connecting the control medium connections and the tank connections of the respective pilot valves with each other respectively by the first and the second channels, the first and the second channels extending between the two installation bores for connection respectively with a control pressure medium source and with a tank;

arranging the two channels to extend parallel to one another and parallel to an actuating axis of the control piston, the control pressure medium connections and the tank connections of the pilot valves being adapted to an arrangement of the channels; and wherein said constructing step includes steps of casting the housing, and casting said first and said second hydraulic channels concurrently with the casting of the housing.

* * * * *